252-79 AJ 157 EX
8/25/86 OR 4,608,188

United States Patent [19]
Parker et al.

[11] Patent Number: 4,608,188
[45] Date of Patent: Aug. 26, 1986

[54] DISHWASHING COMPOSITION

[75] Inventors: Edward J. Parker, Woodhaven; Kenneth C. Scott, Grosse Ile, both of Mich.

[73] Assignee: BASF Corporation, Wyandotte, Mich.

[21] Appl. No.: 722,457

[22] Filed: Apr. 12, 1985

[51] Int. Cl.[4] ..... C11D 3/075; C11D 3/395
[52] U.S. Cl. ..... 252/99; 252/135; 252/174.13; 252/174.24; 252/DIG. 2
[58] Field of Search ..... 252/99, 135, 174.24, 252/174.13, DIG. 2

[56] References Cited

U.S. PATENT DOCUMENTS

| | | | |
|---|---|---|---|
| 3,579,455 | 5/1971 | Sabatelli et al. | 252/135 |
| 3,627,686 | 12/1971 | Sabatelli et al. | 252/527 |
| 3,700,599 | 10/1972 | Mizuno et al. | 252/99 |
| 3,764,559 | 10/1973 | Mizuno et al. | 252/99 |
| 3,887,480 | 6/1975 | Rue et al. | 252/135 |
| 4,203,858 | 5/1980 | Chakrabarti | 252/135 |
| 4,272,394 | 6/1981 | Kaneko | 252/99 |
| 4,284,524 | 8/1981 | Gilbert | 252/99 |
| 4,306,987 | 12/1981 | Kaneko | 252/99 |
| 4,539,144 | 9/1985 | de Ridder et al. | 252/526 |

FOREIGN PATENT DOCUMENTS 1527706 10/1978 United Kingdom .

*Primary Examiner*—Prince E. Willis
*Attorney, Agent, or Firm*—Bernhard R. Swick

[57] ABSTRACT

A low phosphate machine dishwashing composition comprising an admixture of by weight about 7 to 8 percent of a maleic acid-acrylic acid copolymer, about 10 to 20 weight percent of an alkaline condensed phosphate salt, about 2 to 4 percent of a blend of ethylene oxide-propylene oxide block copolymers and about 20 to 40 percent of an alkaline carbonate.

18 Claims, No Drawings

DISHWASHING COMPOSITION

BACKGROUND OF THE INVENTION

This invention relates to a dishwashing detergent composition for use in dishwashing machines.

It is well known that strongly alkaline solutions have been used in institutional and household dishwashing machines for washing dishes, glasses, and other cooking and eating utensils. Ordinary tap water is customarily used with a cleaning composition to form a cleaning solution and for rinsing purposes subsequent to the cleaning operation. However, spotting on dishes and glassware by inorganic salt residues and precipitates has been a major problem. In the past these problems were at least partially solved in machine dishwashing detergent compositions by the use of phosphorus compounds. However, they are now strenuously objected to on ecological grounds.

In order to eliminate or reduce phosphate requirements in machine dishwashing detergents more recent patents have found a need to resort to the use of polymeric chlelating agents per se or in combination an alkaline detergent salt or salts. However the amount of the polymer that is used in accordance with these patents is directly controlled by the degree of hardness of the water in which the dishwashing composition is to be utilized; for such amount has to be sufficient for purposes of chlelating both the calcium and magnesium ions that are present. Thus the primary function of these agents has been to soften the water in which the dishes, glassware, etc. are to be washed by sequestering those metal cations which cause the hardness of such water. But this requires, for relatively hard water of around 300 ppm or higher of those cations causing such water to be hard, a high polymeric or polyelectrolyte concentration to be present in the composition of the ultimate dishwashing product that is employed.

Accordingly it is the purpose of the instant invention to provide a machine dishwashing composition employing a low amount of phosphorus compounds, i.e. less than 20 percent by weight, and also only requiring a relatively small amount of polymeric chelating agent even in the presence of hard water, the hardness approaching 300 ppm.

SUMMARY OF THE INVENTION

These and other purposes of the instant invention are achieved by a low phosphate machine dishwashing composition comprising an admixture of by weight about 7 to 8 percent of a maleic acid-acrylic acid copolymer, about 10 to 20 weight percent of an alkaline condensed phosphate salt, about 2 to 4 percent of a blend of ethylene oxide-propylene oxide block copolymers and about 20 to 40 percent of an alkaline carbonate.

DESCRIPTION OF THE PREFERRED EMBODIMENTS

The maleic acid acrylic acid copolymer employed in the composition of the instant invention has a weight average molecular weight of about 10,000 to 70,000. This copolymer can be prepared by conventional methods of polymerization well known to those skilled in the art wherein the weight ratio of maleic acid to acrylic acid is from about 1:2 to 1:4.

The alkaline condensed phosphate salt may be any alkaline condensed phosphate salt but is preferably a sodium or potassium salt such as tetrasodium pyrophosphate and those polyphosphates of the calcium and magnesium ion sequestering type whose $NaO/P_2O_5$ or $K_2O/P_2O_5$ ratios range from about 1:1 to 2.0:1. A preferred alkaline condensed phosphate salt is sodium tripolyphosphate.

The nonionic surfactant component of the detergent of the invention is a blend of nonionic surfactants consisting of:

1. a nonionic surfactant having the formula:

$$Y[(EO)_m(A)_nH]_2 \qquad \text{I}$$

wherein EO represents oxyethylene groups which are present in the surfactant polymer in the proportion of about 5 to about 60 percent, preferably about 20 to 30 percent, by weight; Y represents the nucleus of an active hydrogen-containing organic compound having about 2 to about 6 aliphatic carbon atoms and 2 reactive hydrogen atoms; A represents a lower oxyalkylene selected from the group consisting of oxypropylene, oxybutylene, oxytetramethylene or mixtures thereof; m and n are integers individually selected such that said polymer has an average total molecular weight generally of about 500 to about 25,000 and 2. a nonionic surfactant having the formula:

$$Y[(EO)_m(A)_nH]_3 \qquad \text{II}$$

wherein Y represents the nucleus of an active hydrogen-containing organic compound having about 2 to 6 aliphatic carbon atoms and 3 reactive hydrogen atoms, EO represents oxyethylene groups which are present in the surfactant polymer in the proportion of about 5 to 60 percent, preferably about 5 to 15 percent by weight, A, m, n, and molecular weight are as defined herein for formula I.

The blend comprises the nonionics in a weight ratio of the nonionic of formula I to that of formula II of about 90:10 to 10:90. Suitable difunctional initiators include ethylene glycol, propylene glycol, butylene glycol, and tetrahydrofuran. Suitable trifunctional initiators include trimethylol propane, glycerine, and butanetriol. Such nonionics are fully described in U.S. Pat. No. 4,306,987.

The alkaline carbonate salt may be (i) an alkali metal, or ammonium, carbonate. Typical of the alkali metal or ammonium carbonates which can be employed in the compositions of the present invention are the alkali metal, ammonium or substituted ammonium, carbonates; bicarbonates; sesquicarbonates; and mixtures thereof. Illustrative of such carbonates are lithium carbonate, sodium carbonate, potassium carbonate, ammonium carbonate, sodium bicarbonate, potassium bicarbonate, sodium sesquicarbonate, potassium sesquicarbonate, and mixtures thereof. The preferred alkali metal carbonate is sodium carbonate.

The composition of this invention may include conventional machine dishwashing composition additives in normal amounts which make up the balance of the composition. Some of the more important of these are discussed below.

Highly alkaline dishwashing detergents containing no silicates can attack, etch, and darken aluminum utensils. Some of these formulations also have a destructive action on over-the-glaze dish patterns. Suitable proportions of silicates in the dishwashing formulations help overcome these difficulties. The silicate used in the compositions of the present invention is preferably solid granular sodium metasilicate pentahydrate, a commercially available material. In the broader aspects of the invention, sodium silicates in which the mole ratio of $SiO_2$:$Na_2O$ are more than 1:1, e.g., from 2:1 up to 3.2:1, may be used in place of the sodium metasilicate. The sodium silicate (dry basis) generally constitutes from about 10 percent to about 20 percent of the final composition and preferably from about 12 percent to about 14 percent.

Chlorine-releasing agents are also often provided in such dishwashing detergents. The chlorine-releasing agent provides available chlorine during the washing operation and serves to destain dishware and reduce film formation on glassware. Representative chlorine-releasing agents are, in general, alkali metal polychloro isocyanurates, trichloroisocyanuric acid, dichloroisocyanuric acid, sodium or potassium dichloroisocyanurate, [(mono trichloro) tetra-(monopotassium dichloro)] pentaisocyanurate, dichlorodimethyl hydantoin, succinchlorimide, chloramine-T, chloromelamine and chlorinated trisodium phosphate. Preferably the amount of available chlorine present is from about 0.5 to 2.5 percent by weight. A preferred chlorine-releasing agent is a chlorinated isocyanurate which preferably is included in an amount of 1 to 4 percent by weight.

Inert diluents such as alkali metal chlorides, sulfates, nitrites and the like may also be incorporated in the machine dishwashing composition. Illustrative of such diluents are sodium or potassium chloride, sodium or potassium sulfate, sodium or potassium nitrite and the like. For the instant composition, sodium sulfate is particularly preferred and when included is employed in an amount of about 1 to 40 percent by weight.

Additionally small amounts of conventional adjuvants such as perfumes, colorants, chlorinated bleaches, bacterial agents or other similar adjuvants can suitably be employed.

Such conventional additives are employed, generally in the amount of about 0 to 5, preferably 1 to 5 percent by weight. Such additives may also include borates or aluminates for protection of the china, and foam suppressors.

The following examples further illustrate the machine dishwashing compositions and the dishwashing process of the present invention. Unless otherwise stated, all percentages and parts are by weight and all temperatures are in degrees centigrade.

EXAMPLES 1-33

Since the purpose of developing the dishwashing detergent composition of the instant invention is to retard or prevent formation of spots or films on dishes and glassware, compositions were made up and tested for spotting and filming.

The spotting and filming evaluations were performed in a KitchenAid dishwasher (model KDS-60) which had its sump heater disconnected. This was done to eliminate any heating of the water once it had entered the dishwasher. Details of the test procedure follow:

Prepare five drinking glasses, e.g., ten fluid ounce size of 2½' diameter×5⅛" high, by thorough washing, drying and inspection to assure completely spot and streak-free starting conditions. (NOTE: A "black box" which uses fluorescent lights and is constructed in such a way that the glasses are edge-lighted is used to accentuate spots and films.) Place the five glasses in the upper rack of the dishwasher, keeping note of the positioning of each glass. In subsequent washing cycles of this test, the glasses are rotated in position to eliminate spray-pattern effects of the dishwasher. In the bottom rack, to simulate home use conditions, place six 9" chinaware plates and six 9" melamineformaldehyde ware plates in alternate positions and place six knives, six forks and six teaspoons in the separate holder.

The test is started with a cold machine and run for three complete cycles, including heated drying after each cycle. The inlet water temperature is controlled at 120° F. At the start of each dishwasher run, detergent and soil are added. The desired amount of detergent (40 grams) is placed in each dispenser cup. The soil for each cycle is described below.

1st cycle—35 grams olemargarine-powdered milk-10 percent fat soil.

2nd cycle—35 grams oleomargarine-powdered milk-10 percent fat soil plus 12 grams CARNATION brand powdered milk.

3rd cycle—35 grams oleomargarine-powdered milk-10% fat soil plus 15 ml stirred, raw whole egg.

Two separate solutions needed to provide additional water hardness are prepared as shown below. These solutions provide calcium and magnesium ions. Twenty milliters of each solution is added separately to the dishwasher in every water fill. There are four water fills in the dishwasher's complete cycle. Addition of these solutions adds 180 ppm as $CaCO_3$ hardness to the 100 ppm as $CaCO_3$ hardness already present in the local city water. Thus, the total water hardness in these tests is 280 ppm as $CaCO_3$.

(1) Dissolve 176.2 gms $CaCl_2 \cdot 2\ H_2O$ in 3 liters of distilled water.

(2) Dissolve 197.2 gms $MgSO_4 \cdot 7\ H_2O$ in 3 liters of distilled water.

The drinking glasses are rated visually after each full cycle on a scale from 1.0 to 10.0 covering the range from completely covered with to completely free from spots, streaks, and/or film. Spotting and filming are rated separately then averaged to arrive at the final rating. Because the effects are cumulative, the rating after the third cycle can represent the overall performance.

The oleomargarine-powdered milk-10 percent fat soil has the following composition:

| | |
|---|---|
| BLUE BONNET brand oleomargarine | 72 wt. % |
| CARNATION brand powdered milk | 18 wt. % |
| ARMOUR brand lard | 5 wt. % |
| Rendered beef tallow | 5 wt. % |

The results of the above tests are shown in the Table below.

TABLE

| | Wt. Percent | | | | |
|---|---|---|---|---|---|
| Example No. | Surfactant[1] | Polymer[2] | STPP[3] | Soda Ash | Rating |
| 1 | 6 | 8 | 22 | 0 | 7.0 |
| 2 | 0 | 8 | 22 | 0 | 7.0 |
| 3 | 3 | 0 | 22 | 0 | 7.75 |
| 4 | 0 | 8 | 0 | 40 | 7.25 |
| 5 | 3 | 8 | 44 | 0 | 8.0 |
| 6 | 3 | 8 | 0 | 20 | 8.5 |
| 7 | 6 | 8 | 0 | 40 | 8.5 |
| 8 | 3 | 8 | 0 | 20 | 8.5 |
| 9 | 0 | 4 | 44 | 0 | 7.5 |
| 10 | 0 | 0 | 44 | 0 | 8.5 |
| 11 | 0 | 0 | 0 | 20 | 4.0 |

TABLE-continued

| Example No. | Surfactant[1] | Wt. Percent Polymer[2] | STPP[3] | Soda Ash | Rating |
|---|---|---|---|---|---|
| 12 | 6 | 0 | 44 | 0 | 8.7 |
| 13 | 0 | 0 | 44 | 0 | 8.0 |
| 14 | 6 | 0 | 0 | 40 | 4.0 |
| 15 | 3 | 4 | 22 | 20 | 8.25 |
| 16 | 0 | 0 | 0 | 40 | 5.0 |
| 17 | 6 | 0 | 44 | 0 | 8.7 |
| 18 | 6 | 0 | 0 | 20 | 4.0 |
| 19 | 0 | 8 | 22 | 20 | 9.0 |
| 20 | 6 | 8 | 44 | 0 | 7.85 |
| 21 | 4 | 8 | 10 | 15 | 8.5 |
| 22 | 4 | 8 | 5 | 35 | 8.25 |
| 23 | 6 | 4 | 15 | 25 | 7.75 |
| 24 | 3 | 0 | 45 | 10 | 9.25 |
| 25 | 3 | 4 | 0 | 30 | 8.5 |
| 26 | 3 | 0 | 5 | 30 | 7.5 |
| 27 | 3 | 0 | 10 | 40 | 8.5 |
| 28 | 3 | 8 | 10 | 40 | 9.2 |
| 29 | 3 | 8 | 20 | 40 | 8.5 |
| 30 | 4 | 0 | 40 | 10 | 9.8 |
| 31 | 4 | 8 | 10 | 30 | 9.6 |
| 32 | 4 | 8 | 20 | 20 | 9.9 |
| 33 | 4 | 8 | 15 | 30 | 9.7 |

[1]The surfactant employed was a blend of a nonionic surfactant of formula I above using an ethylene glycol initiator and wherein A represents oxy-propylene groups, which surfactant has about 25 weight percent oxyethylene groups and a total molecular weight of about 3000 with a nonionic surfactant of formula II above using a trimethylol propane initiator and wherein A represents oxypropylene groups, which surfactant has about 15 weight percent oxyethylene groups and a total molecular weight of about 4000. Such detergents are well known to those skilled in the art as illustrated by U.S. Pat. 4,306,987.

[2]The polymer employed is a maleic acid-acrylic acid copolymer with a weight average molecular weight of 12,000 to 14,000. The maleic acid-acrylic acid monomer ratio is 30:70 by weight.

[3]STPP designates sodium tripolyphosphate.

All the formulations in the Table above also contained 25 weight percent sodium metasilicate pentahydrate and 1.5 weight percent chlorinated isocyanurate. Sufficient sodium sulfate was added to the composition of each example to bring the total up to 100 weight percent.

Examples 28, 29, 31, 32, and 33 are compositions within the scope of the instant invention. It will be noted that four of these five examples all had ratings above 9 and three were above 9.5, all of which is well above the maximum achieved with compositions of the other examples which are outside the scope of the instant invention. While Example 29, which was within the scope of the instant invention, had a rating of 8.5, which is equal to but not better than the best ratings achieved with compositions outside the scope of the invention, it is to be noted that the amount of sodium carbonate and phosphate are on the borderline of the ranges defining the instant invention and, accordingly, marginal results would be expected. While Example 30, outside the instant invention, achieved a high rating, it employed an excessive amount of phosphate.

The embodiments of the invention in which an exclusive privilege or property is claimed are defined as follows:

1. A low phosphate machine dishwashing composition consisting essentially of:

(A) about 7 to 8 percent of a maleic acid-acrylic acid copolymer having an average molecular weight of about 10,000 to 70,000 and a maleic acid-acrylic acid monomer ratio of about 1:2 to 1:4 by weight, (B) about 10 to 20 percent by weight of an alkaline condensed phosphate salt, (C) about 2 to 4 percent by weight of a blend of nonionic surfactants consisting of:

(1) a nonionic surfactant having the formula:

$$Y[(EO)_m(A)_nH]_2$$

wherein EO represents oxyethylene groups which are present in the surfactant in the proportion of about 5 to about 60 percent by weight; Y represents the nucleus of an active hydrogen-containing organic compound having about 2 to about 6 carbon atoms and 2 reactive hydrogen atoms; A represents a lower oxyalkylene selected from the group consisting of oxypropylene, oxybutylene, oxytetramethylene and mixtures thereof; m and n are integers individually selected such that the average total molecular weight of the polymer is about 500 to about 25,000 and (2) a nonionic surfactant having the formula:

$$Y[(EO)_m(A)_nH]_3$$

wherein Y represents the nucleus of an active hydrogen-containing organic compound having about 2 to 6 aliphatic carbon atoms and 3 reactive hydrogen atoms, EO, A, m, n, molecular weight and percent oxyethylene groups are as defined above;

(D) about 20 to 40 percent of an alkaline carbonate compound the balance conventional machine dishwashing composition additives in normal amounts.

2. The dishwashing composition of claim 1 wherein said alkaline condensed phosphate salt is sodium or potassium tripolyphosphate and said alkaline carbonate compound is sodium or potassium carbonate.

3. The machine dishwashing composition of claim 2 wherein said alkaline condensed phosphate salt is sodium tripolyphosphate and said alkaline carbonate compound is sodium carbonate.

4. The composition of claim 3 including alkali metal silicate in amount of about 10 to 20 percent by weight dry basis.

5. The composition of claim 3 including a chlorinated isocyanurate in amount of about 1 to 4 percent by weight.

6. The composition of claim 3 including about 1 to 40 percent by weight alkali metal sulfate.

7. The composition of claim 6 including about 10 to 20 percent by weight, dry basis, of an alkali silicate and about 1 to 4 percent by weight of a chlorinated isocyanurate.

8. The composition of claim 7 wherein the balance of the composition comprises conventional adjuvants.

9. The composition of claim 8 wherein said silicate is sodium metasilicate and said alkali sulfate is sodium sulfate.

10. The process of washing food soiled utensils in a machine dishwasher comprising contacting said utensils with an aqueous solution of about 0.2 to about 1 percent by weight of the detergent composition of claim 1 at a water temperature of about 80° F. to about 140° F.

11. The process of claim 10 wherein said alkaline condensed phosphate salt is sodium or potassium tripolyphosphate and said alkaline carbonate compound is sodium or potassium carbonate.

12. The process of claim 11 wherein said alkaline condensed phosphate salt is sodium tripolyphosphate and said alkaline carbonate compound is sodium carbonate.

13. The process of claim 12 including alkali metal silicate in amount of about 10 to 20 percent by weight, dry basis.

14. The process of claim 12 including a chlorinated isocyanurate in amount of about 1 to 4 percent by weight.

15. The process of claim 12 including about 1 to 40 percent by weight alkali metal sulfate.

16. The process of claim 15 including about 10 to 20 percent by weight, dry basis, of an alkali silicate and about 1 to 4 percent by weight of a chlorinated isocyanurate.

17. The process of claim 8 wherein the balance of the composition comprises conventional adjuvants.

18. The process of claim 17 wherein said silicate is sodium metasilicate and said alkali metal sulfate is sodium sulfate.

* * * * *